US009629223B2

(12) United States Patent
Matthies et al.

(10) Patent No.: US 9,629,223 B2
(45) Date of Patent: Apr. 18, 2017

(54) LIGHT-EMITTING DEVICE COMPRISING TWO INTERFACES

(71) Applicant: PHOENIX CONTACT GMBH & CO KG, Blomberg (DE)

(72) Inventors: Thorsten Matthies, Barntrup (DE); Frank Büssgen, Detmold (DE)

(73) Assignee: PHOENIX CONTACT GMBH & CO KG, Blomberg (DE)

( * ) Notice: Subject to any disclaimer, the term of this patent is extended or adjusted under 35 U.S.C. 154(b) by 0 days.

(21) Appl. No.: 14/775,225

(22) PCT Filed: Jan. 30, 2014

(86) PCT No.: PCT/EP2014/051791

§ 371 (c)(1),
(2) Date: Sep. 11, 2015

(87) PCT Pub. No.: WO2014/139724

PCT Pub. Date: Sep. 18, 2014

(65) Prior Publication Data

US 2016/0029463 A1 Jan. 28, 2016

(30) Foreign Application Priority Data

Mar. 14, 2013 (DE) ..... 10 2013 102 644

(51) Int. Cl.
*H05B 37/02* (2006.01)
*H05B 33/08* (2006.01)

(52) U.S. Cl.
CPC ..... *H05B 37/0254* (2013.01); *H05B 33/0845* (2013.01); *H05B 33/0884* (2013.01); *H05B 37/0272* (2013.01)

(58) Field of Classification Search
None
See application file for complete search history.

(56) References Cited

U.S. PATENT DOCUMENTS

| | | | | |
|---|---|---|---|---|
| 8,299,719 | B1 | 10/2012 | Moshimoroozi | |
| 2002/0114155 | A1 | 8/2002 | Katogi et al. | |
| 2007/0013557 | A1* | 1/2007 | Wang | B64F 1/20 340/945 |

(Continued)

FOREIGN PATENT DOCUMENTS

| | | | |
|---|---|---|---|
| DE | 10 2010 003 797 | A1 | 10/2011 |
| WO | WO 98/39951 | A1 | 9/1998 |

(Continued)

OTHER PUBLICATIONS

International Search Report (PCT/ISA/210) mailed on May 9, 2014, by the German Patent Office as the International Searching Authority for International Application No. PCT/EP2014/051791.

(Continued)

*Primary Examiner* — Dedei K Hammond
(74) *Attorney, Agent, or Firm* — Buchanan Ingersoll & Rooney PC

(57) ABSTRACT

The invention relates to a light-emitting device comprising a first interface for supplying energy to the light-emitting device and comprising a second interface for transmitting a control signal or a plurality of control signals for controlling a lighting property of a light source of the light-emitting device.

9 Claims, 4 Drawing Sheets

(56) References Cited

U.S. PATENT DOCUMENTS

| | | | | |
|---|---|---|---|---|
| 2007/0091596 | A1* | 4/2007 | Grossman | F21S 2/00 362/217.09 |
| 2009/0021955 | A1* | 1/2009 | Kuang | B60Q 3/0259 362/479 |
| 2010/0295468 | A1 | 11/2010 | Pedersen et al. | |
| 2013/0147269 | A1 | 6/2013 | Zimmermann et al. | |

FOREIGN PATENT DOCUMENTS

| | | | |
|---|---|---|---|
| WO | WO 2011/041816 | A1 | 4/2011 |
| WO | WO 2011/116404 | A1 | 9/2011 |
| WO | 2012/145766 | A2 | 10/2012 |

OTHER PUBLICATIONS

Chinese Office Action issued in corresponding Chinese Patent Application No. 2014800142848 dated Aug. 24, 2016, with translation.

* cited by examiner

LIGHT-EMITTING DEVICE COMPRISING TWO INTERFACES

The invention relates to a light-emitting device.

Light-emitting devices, in particular, LED machine lights, are used for lighting in or at machines. These light-emitting devices are switched on and off as the result of a supply voltage of the light-emitting device being connected or disconnected via a switch or a relay. However, this allows only the switching on or off of the light-emitting device, to the exclusion of any further function. Additional functions can be implemented either not at all or only at great (installation) expense.

It is therefore the object of the present invention to supply a light-emitting device having flexible lighting properties.

This object is achieved by the subject matters having the features according to the independent claims. Advantageous embodiments are the subject matter of the dependent claims, the description and the drawings.

The present invention is based on the finding that the above object may be achieved by a light-emitting device having different interfaces for the energy supply or for the control signals. Such a light-emitting device makes it possible to reduce the wiring complexity and it may be flexibly used.

According to a first aspect, the object is achieved in that the light-emitting device includes a first interface for supplying energy to the light-emitting device and a second interface for transmitting a control signal or multiple control signals for controlling a lighting property of a lighting source of the light-emitting device. The technical advantage achieved thereby is that, via the first interface, the light-emitting device may be supplied with electrical energy, for example, in order to operate the light-emitting device, and that via the second interface, it may be controlled by means of the control signal or by means of multiple control signals.

The lighting property may, for example, comprise a dimming and/or a flash mode.

The transmitting may, for example, comprise a receiving of the control signal or a sending or forwarding of the control signal, for example, to a lighting source driver, such as an LED driver.

The lighting source may, for example, comprise an LED or an LED panel or a halogen light or a halogen light panel.

The second interface may be unidirectional or bidirectional in design. The second interface may be designed as a fieldbus segment, for example, for industrial applications according to Standard IEC 61158 (Digital data communication for measurement and control—Fieldbus for use in industrial control systems), or as an Ethernet interface, for example, for a real-time capable Ethernet-based fieldbus according to Standard IEC 61784-2. The second interface may also be designed as a communication interface.

In one advantageous embodiment, the at least one control signal is or comprises a dimming signal for controlling, for example, for dimming, a light intensity of the lighting source. The technical advantage achieved thereby is that the light intensity may be varied by means of the dimming signal, so that an adjusted light intensity may be provided by the light-emitting device.

In another advantageous embodiment, the at least one control signal is or comprises a flash signal for controlling a lighting frequency and/or lighting duration of the lighting source. The technical advantage achieved thereby is that the light-emitting device generates light flashes of desired frequency and/or duration, in order, for example, to produce a stroboscope effect.

In another advantageous embodiment, the second interface is designed to transmit, in particular to receive or emit, a status signal, in particular, a fault signal. The technical advantage achieved thereby is that a fault signal may be emitted or received via the second interface, so that, for example, a malfunction of the light-emitting device may be signaled. A malfunction may indicate, for example, a defect of the lighting source. Such a defect may be detected, for example, by means of a current or voltage measurement.

In another advantageous embodiment, the first interface is designed for wireless energy transmission or for wired or for fiber optic energy transmission. The technical advantage achieved thereby is that a wireless energy transmission does not require the laying of lines transmitting electrical energy. In the case of a wired or fiber optic energy transmission on the other hand, it is possible to transmit greater amounts of energy or to reduce energy losses.

In another advantageous embodiment, the second interface is designed for wireless transmission or for wired or for fiber optic transmission of the at least one control signal and/or of a status signal. The technical advantage achieved thereby is that a wireless transmission does not require the laying of electrical lines. In the case of a wired or fiber optic energy transmission on the other hand, it is possible to achieve a higher energy transmission efficiency.

In another advantageous embodiment, the light-emitting device includes a third interface for supplying energy to another light-emitting device. The technical advantage achieved thereby is that multiple light-emitting devices may be connected in series and supplied with electrical energy, which further reduces the wiring complexity.

In another advantageous embodiment, the third interface is designed for wireless energy transmission or for wired or for fiber optic energy transmission. The technical advantage achieved thereby is that a wireless energy transmission does not require the laying of lines transmitting electrical energy. In the case of a wired or fiber optic energy transmission on the other hand, it is possible to achieve a higher energy transmission efficiency.

In another advantageous embodiment, the light-emitting device includes an additional, for example, fourth interface for transmitting, for example, emitting the at least one control signal and/or a status signal to an additional light-emitting device and/or for receiving an additional control signal and/or a status signal/status signals of an additional light-emitting device.

The additional status signal may comprise the properties of the aforementioned control signal.

The additional status signal may comprise the properties of the aforementioned status signals.

The additional, for example, fourth interface may be unidirectional or bidirectional in design. The additional, for example, fourth interface may be designed as a fieldbus segment, for example, for industrial applications according to Standard IEC 61158 (Digital data communication for measurement and control—Fieldbus for use in industrial control systems), or as an Ethernet interface, for example, for a real-time capable Ethernet-based fieldbus according to Standard IEC 61784-2. The fourth interface may also be designed as a communication interface.

The technical advantage achieved thereby is that multiple light-emitting devices may be electrically connected in series, in order to loop the control signal and/or a status signal through a series connection of light-emitting devices, which further reduces the wiring complexity.

In another advantageous embodiment, the additional interface is designed for wireless transmission or for wired or for fiber optic transmission of the control signal and/or of the status signal. The technical advantage achieved thereby is that a wireless energy transmission does not require the laying of electrical lines. In the case of a wired or fiber optic energy transmission on the other hand, it is possible to achieve a higher energy transmission efficiency.

According to a second aspect, the object is achieved by a control device having an interface for transmitting, for example, emitting or receiving a control signal or multiple control signals for controlling a lighting property of a lighting source or light-emitting device and/or for receiving a status signal from a light-emitting device. The control signal may include the properties of the aforementioned status signal. The status signal may include the properties of the aforementioned status signal. The technical advantage achieved thereby is that via the interface, it is possible to control the light-emitting device.

In one advantageous embodiment, the at least one control signal is or comprises a dimming signal for controlling a light intensity of the lighting source. The technical advantage achieved thereby is that the light intensity may be varied by means of the dimming signal, so that an adjusted light intensity may be provided by the light-emitting device.

In another advantageous embodiment, the at least one control signal is or comprises a flash signal for controlling a lighting frequency and/or lighting duration of the lighting source. The technical advantage achieved thereby is that the light-emitting device generates light flashes of desired frequency and/or duration, in order, for example, to produce a stroboscope effect.

In another advantageous embodiment, the interface is designed to transmit, in particular to emit, a status signal, in particular, a fault signal. The technical advantage achieved thereby is that a status signal may be received via the second interface, so that, for example, a malfunction of the light-emitting device may be efficiently signaled. A malfunction may, for example, be a defect of the light-emitting device or the lighting source.

In another advantageous embodiment, the interface for transmitting the at least one control signal and/or status signal is designed for wireless transmission or for wired or for fiber optic transmission of the control signal and/or status signal. The technical advantage achieved thereby is that a wireless transmission does not require the laying of electrical lines. In the case of a wired or fiber optic energy transmission on the other hand, it is possible to achieve a higher energy transmission efficiency.

In another advantageous embodiment, the control device includes an interface for supplying energy to a light-emitting device. The technical advantage achieved thereby is that the control device is able to supply the light-emitting device with electrical energy, and no separate energy source is required.

In another advantageous embodiment, the interface for supplying energy to a light-emitting device is designed for wireless energy transmission or for wired or for fiber optic energy transmission. The technical advantage achieved thereby is that a wireless energy transmission does not require the laying of lines transmitting electrical energy. In the case of a wired or fiber optic energy transmission on the other hand, it is possible to transmit greater amounts of energy.

According to a third aspect, the object is achieved by a lighting system, including a light-emitting device of said type and a control device of said type. The technical advantage achieved thereby is that the light-emitting device may be supplied with electrical energy via the first interface, for example, for operating the lighting source, and may be controlled by means of the control signal via the second interface.

Additional exemplary embodiments are explained with reference to the appended drawings, in which:

FIG. 1 shows a light-emitting device 100. According to one embodiment, the light-emitting device 100 is designed as a machine lamp, in particular, as an LED machine lamp, for lighting in or at machines.

Figure 1:
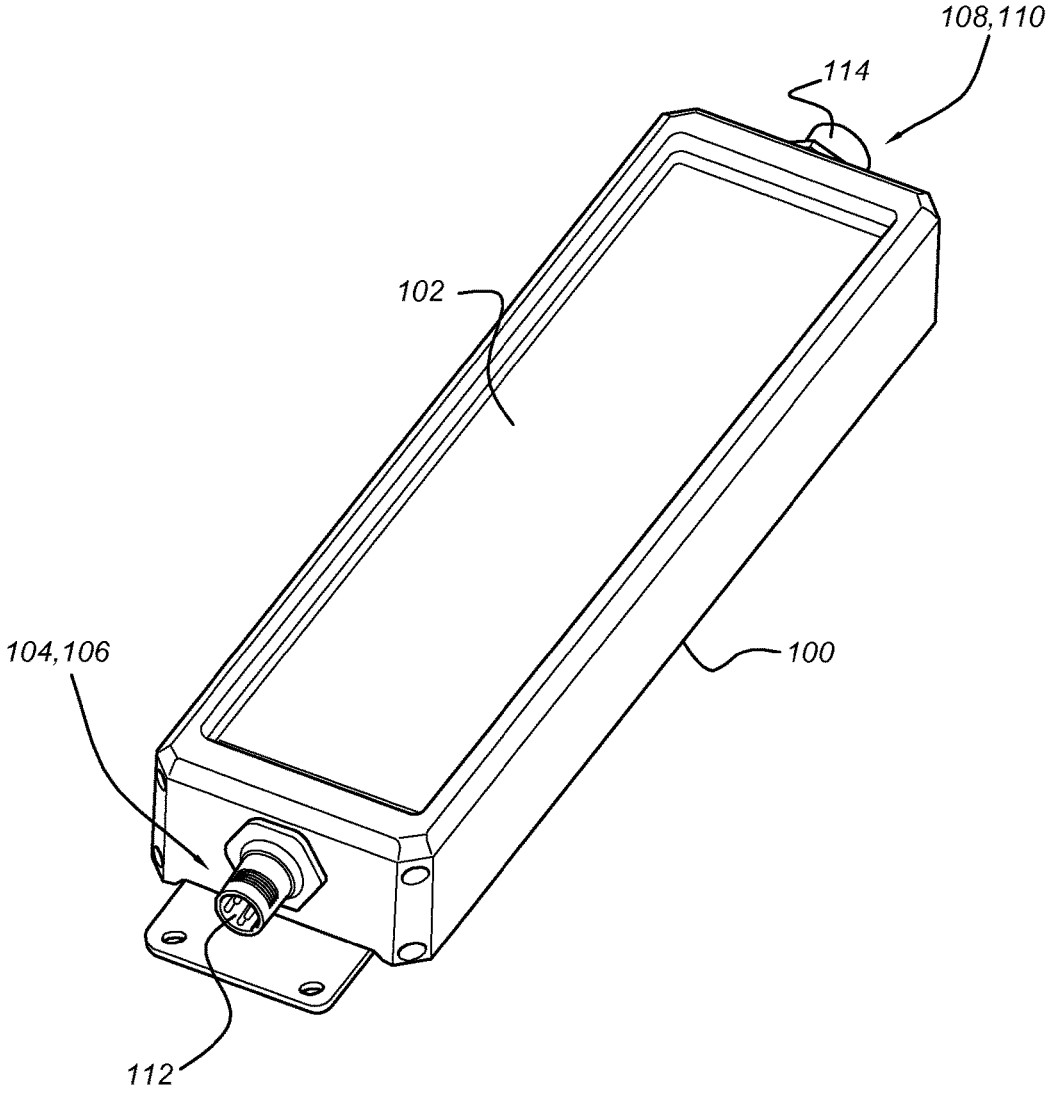
FIG. 1 shows a schematic representation of a light-emitting device.

The light-emitting device 100 according to one embodiment comprises a lighting source 102 which, according to one embodiment, is designed as an LED lighting element. The light-emitting device 100 according to one embodiment further includes a plug 112 and a socket 114. According to one embodiment, the plug 112 is associated with a first interface 104 and a second interface 106. The first interface 104 in this arrangement is used to supply energy to the light-emitting device 100, in particular, the lighting source 102 thereof, whereas a control signal or multiple control signals (not depicted in FIG. 1) for controlling the light-emitting device 100 may be transmitted to the light-emitting device 100 via the second interface 106. Furthermore, according to one embodiment, a status signal (not depicted in FIG. 1) originating from the light-emitting device 100 may be emitted or received via the second interface 106.

According to one embodiment, the light-emitting device includes an optional third interface 108 and a fourth interface 110, which are associated with the socket 114. The third interface 108 in this arrangement is used to supply energy to an additional light-emitting device (not depicted in FIG. 1), whereas a control signal or multiple control signals for controlling the additional light-emitting device 100 may be transmitted to the additional light-emitting device 100 via the fourth interface 110. Furthermore, according to one embodiment, a control signal or multiple status signals or a status signal may also be received or sent via the fourth interface 110, the status signal sent originating from the additional light-emitting device 406, as is explained later below. Thus, via the socket 114, it is possible to electrically connect an additional light-emitting device 406 to the light-emitting device 100, as is described later below.

Figure 2:
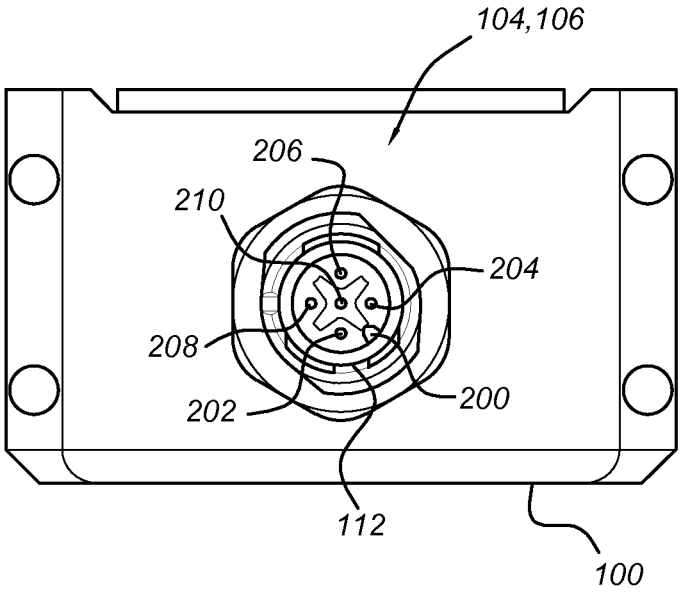
FIG. 2 shows a partial view of a light-emitting device.

FIG. 2 shows the plug 112, designed for example, as a 5-pole M12 built-in plug connector. The plug 112 according to one embodiment includes an A-coding 200 and five contacts 202 through 210.

The allocation of the five contacts 202 through 210 is, for example, as follows:

Contact 202 is allocated the supply voltage V,

Contact 204 is allocated the flash signal B

Contact 206 allocated ground M

Contact 208 is allocated the dimming signal D, and

Contact 210 is allocated the status signal F, for example, the fault signal.

Figure 3:
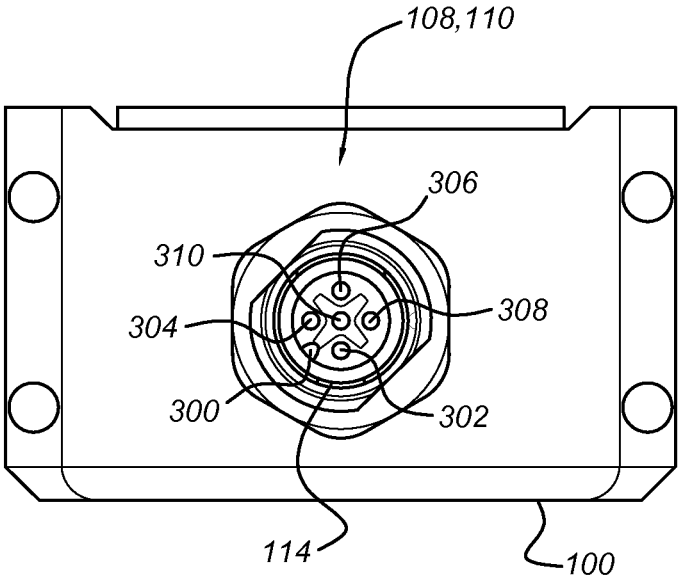
FIG. 3 shows another partial view of a light-emitting device.

FIG. 3 shows the socket 114 which, according to one embodiment, is designed as a 5-pole M12 built-in plug connector. The socket 114 according to one embodiment includes an A-coding 300 as well as five contacts 302 through 310.

The allocation of the five contacts 302 through 310 is, for example, as follows:

Contact 302 is allocated the supply voltage V,

Contact 304 is allocated the flash signal B

Contact 306 is allocated ground M

Contact 308 is allocated the dimming signal D, and

Contact 310 is allocated the status signal F, for example, the fault signal.

Figure 4:
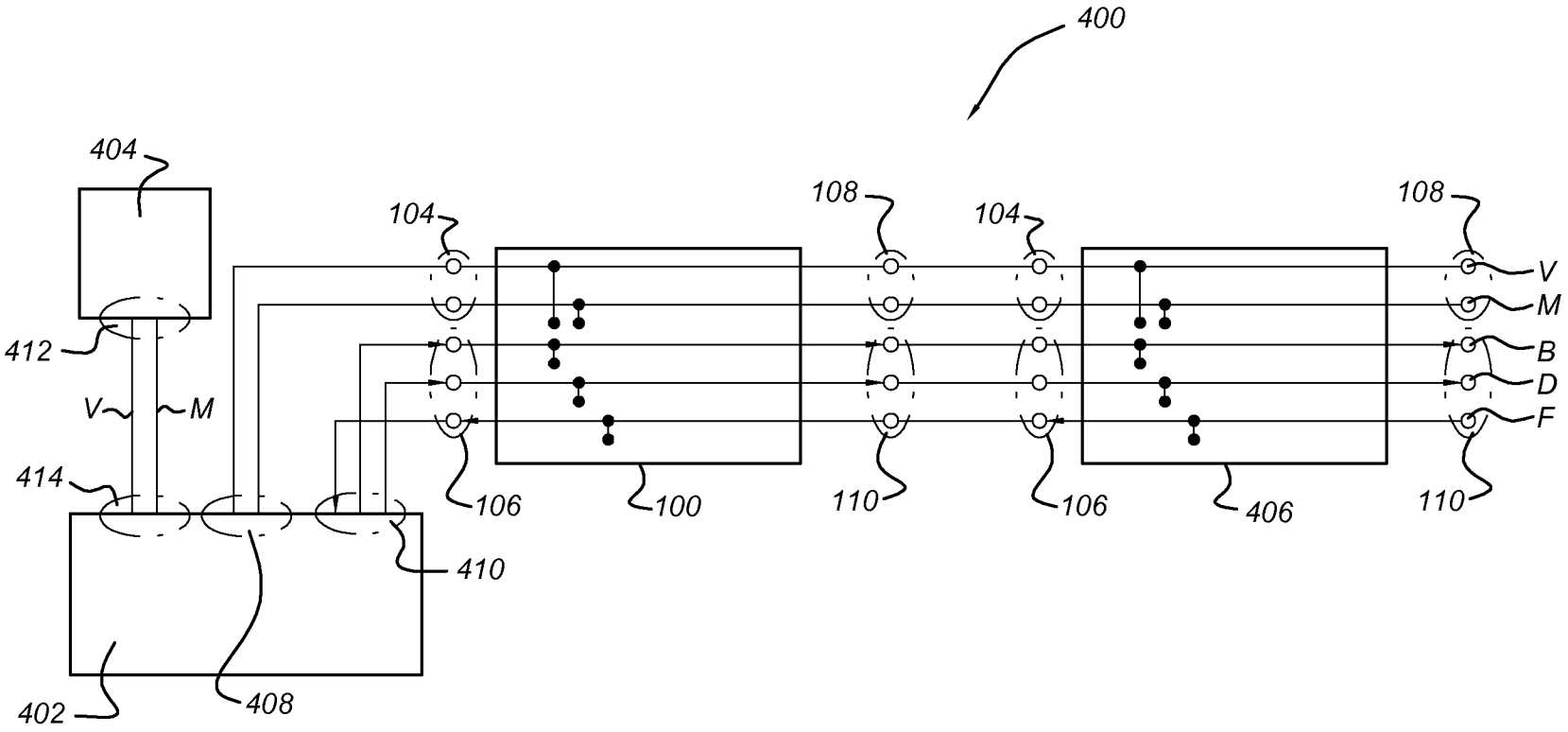
FIG. 4 shows a schematic circuit diagram of a lighting system.

FIG. 4 shows a lighting system 400. The lighting system 400 according to one embodiment includes a control device 402, an energy source 404, as well as an additional light-emitting device 406.

The energy source 404 according to one embodiment supplies electrical energy, which is transmitted via a supply interface 412 of the energy source 404 to the control device 402. For this purpose, a supply interface 414 of the control device 402 is electrically connected to the supply interface 412 of the energy source 404. The supply interface 412 of the energy source 404 and the supply interface 414 of the control device 402 include terminals for a supply voltage V, 24 volts according to one embodiment, and for ground M.

The control device 402 according to one embodiment includes, in addition to the supply interface 414, a first interface 408 for supplying energy to a light-emitting device 100, and a second interface 410 for controlling a lighting property of the lighting source 102 of the light-emitting device 100. The first interface 408 of the control device 402 according to one embodiment includes two terminals for the supply voltage V and ground M.

The second interface 410 of the control device 402 according to one embodiment includes three terminals. Two of the three terminals are provided for the control signals B, D for controlling a lighting property of the lighting source 102 of the light-emitting device 100, and one of the three terminals is provided for a status signal F of the light-emitting device 100. The control signals B, D according to one embodiment comprise a flash signal B and a dimming signal D. The status signal F according to one embodiment is a fault signal.

The flash signal B according to one embodiment is a pulse width modulated control signal and causes an electric current for supplying the lighting source 102 to be switched on or off. A control signal level logic one interrupts the electric current, whereas the electric current is flowing a control signal level logic is zero. Thus, according to one embodiment, the input for the flash signal B of the second interface 106 of the light-emitting device 100 is implemented as a low-active input, so that the lighting source 102 lights up, even when the flash signal B is omitted or is non-existent.

The dimming signal D according to one embodiment is also a pulse width modulated control signal. According to one embodiment, a duty factor or duty cycle of zero to 100% corresponds to a maximum electrical current strength for supplying the lighting source 102, i.e., the lighting source 102 lights up with maximum light intensity.

Furthermore, according to one embodiment, the result of a duty factor or duty cycle of, for example, greater than zero to 0.95, is that the lighting source 102 is operated in dimming mode. The current strength, depending on the duty factor, now lies between zero and 100% of the maximum electrical current strength for supplying the lighting source 102. Finally, according to one embodiment, the result of a duty factor or duty cycle of, for example, greater than 0.95, is that the lighting source 102 fails to light up. In other words, a duty factor or duty cycle of, for example, 0.95 according to one embodiment, represents a switching threshold for a change of the dimming mode to lighting source 102 switched off and vice versa.

Moreover, according to one embodiment, the input of the dimming signal D of the second interface 106 of the light-emitting device 100 is implemented as a low active disable input, so that the lighting source 102 lights up, even when the dimming signal D is omitted or is non-existent.

The status signal F according to one embodiment is a digital status signal. In the event of a fault, the status signal level of the status signal F is set to logic one, whereas normally it is set to logic zero. The status signal F according to one embodiment indicates an excess temperature within the light-emitting device 100 and/or a voltage failure of the LED voltage, for example, for supplying energy to the lighting source 102.

The first interface 408 of the control device 402 according to one embodiment is electrically connected to the first interface 104 of the light-emitting device 100, so that the light-emitting device 100 is electrically connected to the supply voltage V and to ground M. The second control interface 410 of the control device 402 according to one embodiment is connected to the second interface 106 of the light-emitting device 100.

The first interface 104 depicted in FIG. 4 and the second interface 106 of the light-emitting device 100 according to one embodiment are combined in the plug 112 which, according to one embodiment, is designed as a 5-pole M12 built-in plug. According to one embodiment, the five terminals are allocated as follows (see also FIG. 2):

Contact 202 is allocated the supply voltage V

Contact 204 is allocated the flash signal B

Contact 206 is allocated ground M

Contact 208 is allocated the dimming signal D, and

Contact 210 is allocated the status signal F, for example, the fault signal.

Thus, a control signal, the flash signal B and/or the dimming signal D according to one embodiment, may be transmitted from the control device 402 to the first light-emitting device 100. Thus, according to one embodiment, the flash signal B and/or the dimming signal D are emitted by the control device 402.

Upon receipt of the flash signal B, the lighting frequency and/or lighting duration of the lighting source 102 is changed, for example, i.e., phases of an illuminating and non-illuminating lighting source 102 follow in succession, so that the lighting source 102 generates light flashes. Upon receipt of the dimming signal D on the other hand, the light intensity of the lighting source 102 is changed. If the status signal F is a fault signal, the status signal F may be transmitted by the light-emitting device 100 to the first control device 402. Thus, according to one embodiment, the status signal F is received by the control device 402. When a fault occurs, the light-emitting device 100 automatically switches the lighting source 102 off. The light-emitting device 100 automatically switches the lighting source 102 back on if the fault (for example, excess temperature) is no longer present, insofar as according to one embodiment a static dc voltage signal, for example, a 24 V dc signal, is not present at the inputs for the flash signal B or the dimming signal D.

FIG. 4 also shows that an additional light-emitting device 406 is connected to the socket 114 of the light-emitting device 100. The additional light-emitting device 406 has the same design as the light-emitting device 100 described with reference to FIGS. 1 through 3.

According to one embodiment the five terminals of the socket 114 are allocated as follows (see also FIG. 3):

Contact 302 is allocated the supply voltage V,

Contact 304 is allocated the flash signal B

Contact 306 is allocated ground M

Contact 308 is allocated the dimming signal D, and

Contact 310 is allocated the status signal F, for example, the fault signal.

According to one embodiment, the third interface 108 of the light-emitting device 100 is electrically connected to the first interface 104 of the additional light-emitting device 406, and the fourth interface 110 of the light-emitting device 100 is electrically connected to the second interface 106 of the additional light-emitting device 406. In this arrangement, the first interface 104 of the light-emitting device 100 according to one embodiment is designed in such a way that the supply voltage V and the ground M are looped through the light-emitting device 100, so that at the socket 114 of the light-emitting device 100, the supply voltage V is available at contact 302 and the ground M for operating the additional light-emitting device 406 is available at contact 306.

Furthermore, according to one embodiment, the terminals at the contact 304 for the flash signal B, at the contact 308 for the dimming signal D and at the contact 310 for the fault signal F are electrically connected to the corresponding contacts 204, 208, 210 of the second interface 106 of the additional light-emitting device 406.

Thus, a flash signal B and/or a dimming signal D may be looped through the light-emitting device 100 by the control device 402 and may be fed to the additional light-emitting device 406, upon receipt of which the additional light-emitting device 406 changes the light intensity and/or upon receipt of the flash signal B changes the lighting frequency and lighting duration.

Thus, according to one embodiment, the flash signal B and/or the dimming signal D is emitted by the control device 402. Furthermore, according to one embodiment, a status signal F may be looped through the light-emitting device 100 and forwarded to the control device 402, which may subsequently cause a deactivation of the lighting system 400, for example, by means of a corresponding dimming signal D. Thus, according to one embodiment, the status signal F is received by the control device 402.

Figure 5:
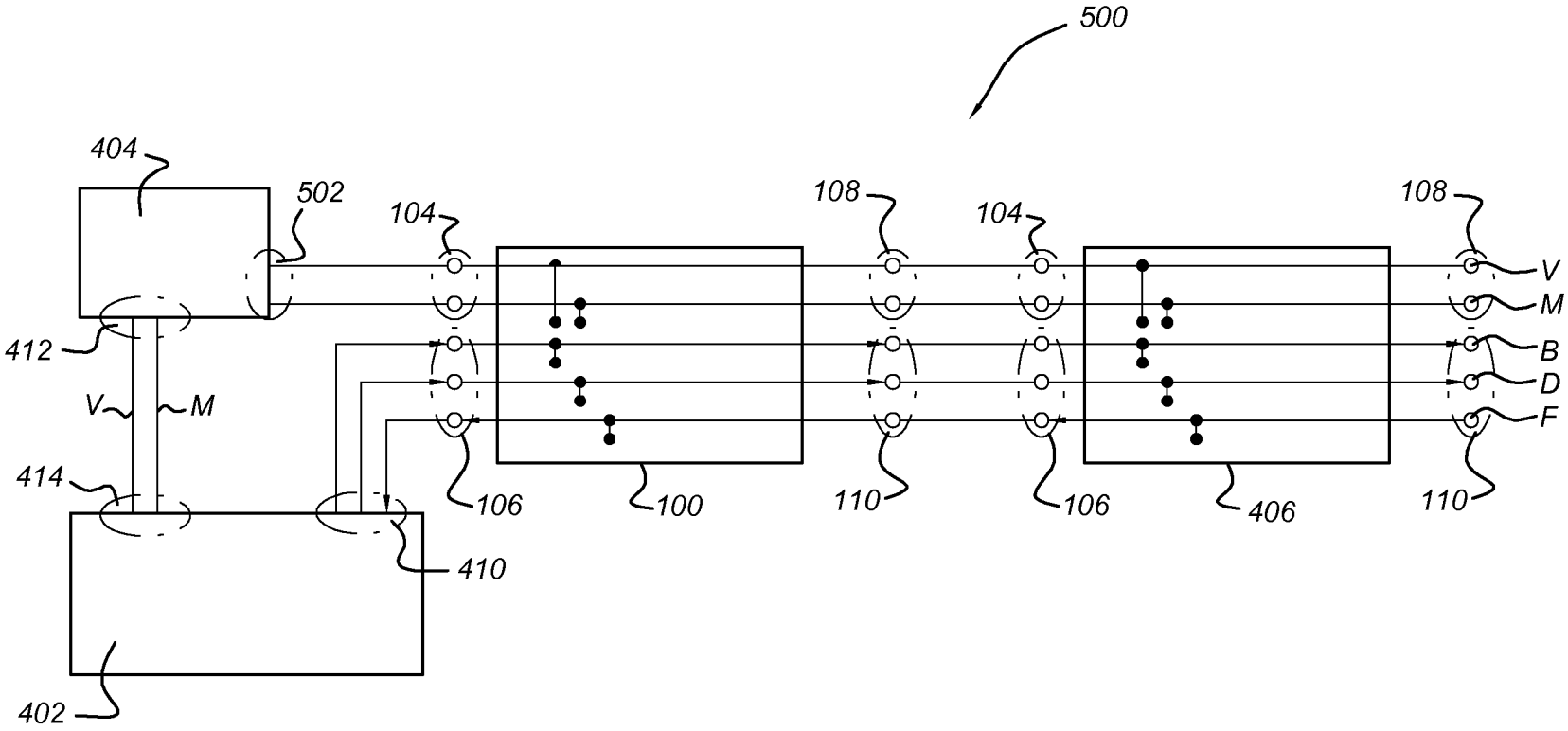
FIG. 5 shows another schematic circuit diagram of another lighting system.

FIG. 5 shows another exemplary embodiment of a lighting system 500, which differs from the previous exemplary embodiment, in that the energy source 404 is electrically connected directly to the first interface 104 of the light-emitting device 100 via an additional supply interface 502.

Thus, the energy source 404 in this exemplary embodiment includes the supply interface 412 and the additional supply interface 502. Furthermore, the control device 402 in this exemplary embodiment includes, in addition to the supply interface 414, the interface 410 for transmitting, for example, emitting the control signal B, D and/or, for example, receiving the status signal F.

In the exemplary embodiment depicted in FIG. 5, the energy source 404 supplies electrical energy to the control unit 402 via its supply interface 412 and, at the same time, to the light-emitting device 100 via its additional supply interface 502. In this exemplary embodiment, the additional light-emitting device 406 connected in series to the light-emitting device 100 is also supplied with energy.

In the exemplary embodiments depicted in FIGS. 4 and 5, the additional light-emitting device 406, like the light-emitting device 100, includes a third interface 108 and a fourth interface 110, so that the lighting system 400 may be expanded to include additional light-emitting devices.

Furthermore, in the exemplary embodiments depicted in FIGS. 4 and 5, the first interface 104, the second interface 106, the third interface 108, the fourth interface 110 of the first light-emitting device 100, and also the first interface 104, the second interface 106, the third interface 108, the fourth interface 110 of the additional light-emitting device 406 are wired or fiber optic in design. Furthermore, the first interface 408 and the second interface 410 in these exemplary embodiments, as well as the supply interface 414 of the control device 402, as well as the supply interface 412 of the energy source 404 are wired or fiber optic in design.

In deviation thereof, however, the first interface 104 and/or the third interface 108 of the first light-emitting device and/or also the first interface 104 and the third interface 108 of the additional light-emitting device 406, as well as the first interface 408 of the control device 402 may be designed for wireless energy transmission, for example, by means of inductive or capacitive coupling. Moreover, the supply interface 412 of the energy source 404 and the supply interface 414 of the control device 402 may be designed for wireless energy transmission, for example, by means of inductive or capacitive coupling.

Furthermore, the second interface 106 and/or the fourth interface 110 of the light-emitting device 100, and also the second interface 106 and/or the fourth interface 110 of the additional light-emitting device 406, as well as the second interface 410 of the control device 402 is designed for wireless data transmission, for example by means of Bluetooth or WLAN.

The light-emitting device 100 and the additional light-emitting device 406 according to one embodiment include an LED driver for activating the lighting source 102. According to one embodiment, this involves a standard driver for activating the lighting source 102. The LED driver may comprise software components and hardware components. The LED driver is electrically connected to the supply voltage V and to ground M. According to one embodiment, an overvoltage protection and reverse polarity protection are connected upstream of the LED driver, according to one embodiment, a spark gap and a MOSFET.

Furthermore, the LED driver may include or be associated with, for example, a Schmitt trigger, in order to generate a status signal, for example, a fault signal, in case, for example, the supply voltage drops below a predetermined limit value. Moreover, the LED driver may be associated with a logic AND gate or the LED driver includes an AND gate, to which, in addition to the flash signal B, another status signal is fed, before it is fed to an input for a pulse wide modulated control signal. Moreover, the LED driver includes an input for the dimming signal D which, according to one embodiment, is also a pulse width modulated control signal. Connected upstream from the input according to one embodiment is a voltage divider, consisting of ohmic resistors, as well as a low-pass.

Furthermore, a selector switch input according to one embodiment may be associated with or connected upstream from the LED driver, with which one of two operating modes may be selected, for example, two different radiation characteristics, for example, 100° and 50° radiation angles. Thus, a light-emitting device 100 and the additional light-emitting device 406 may be used with a standard LED driver.

LIST OF REFERENCE NUMERALS

100 Light-emitting device

102 Lighting source

104 First interface
106 Second interface
108 Third interface
110 Fourth interface
112 Plug
114 Socket
200 A-coding
202 First contact
204 Second contact
206 Third contact
208 Fourth contact
210 Fifth contact
300 A-coding
302 First contact
304 Second contact
306 Third contact
308 Fourth contact
310 Fifth contact
400 Lighting system
402 Control device
404 Energy source
406 Additional light-emitting device
408 First interface
410 Second interface
412 Supply interface
414 Supply interface
500 Lighting system
502 Supply interface
B Flash signal
D Dimming signal
F Status signal
M Ground
V Supply voltage

The invention claimed is:

1. A light-emitting device, comprising:

a first interface for supplying energy to the light-emitting device; and a second interface for transmitting one control signal or multiple control signals for controlling a lighting property of a lighting source of the light-emitting device, wherein the one or more control signals include a dimming signal for controlling a light intensity of the lighting source and a flash signal for controlling at least one of lighting frequency and lighting duration of the lighting source, wherein the second interface is designed to transmit, receive, or emit a status signal or a fault signal, wherein the light-emitting device includes a 5-pole plug connector, which includes the first interface and the second interface, and wherein the 5-pole plug connector includes 5 contacts in which the first contact is allocated a supply voltage, the second contact is allocated the flash signal, the third contact is allocated a ground, the fourth contact is allocated the dimming signal, and the fifth contact is allocated the fault signal.

2. The light-emitting device according to claim 1, wherein the second interface is designed for wireless transmission or for wired transmission or fiber optic transmission of at least one of the one or multiple control signals and the status signal.

3. The light-emitting device according to claim 2, wherein the light-emitting device includes a third interface for supplying energy to an additional light-emitting device.

4. The light-emitting device according to claim 3, wherein the third interface is designed for wireless energy transmission or for wired energy transmission or for fiber optic energy transmission.

5. The light-emitting device according to claim 4, wherein the light-emitting device includes a fourth interface for transmitting at least one of the one or more control signals, at least one of a status signal to an additional light-emitting device, a status signal for receiving a control signal, and a status signal of an additional light-emitting device.

6. A control device, comprising:

an interface for transmitting one control signal or multiple control signals for controlling a lighting property of a lighting source of a light-emitting device and/or for receiving a status signal of a light-emitting device, wherein the one or more control signals include a dimming signal for controlling a light intensity of the lighting source and a flash signal for controlling at least one of lighting frequency and lighting duration of the lighting source, wherein the interface is designed to transmit a status signal or a fault signal, wherein the light emitting device includes a 5-pole plug connector, which includes the interface, wherein the 5-pole plug connector includes 5 contacts, wherein the first contact is allocated a supply voltage, the second contact is allocated the flash signal, the third contact is allocated a ground, the fourth contact is allocated the dimming signal, and the fifth contact is allocated the fault signal.

7. The control device according to claim 6, wherein the control device includes an interface for supplying energy to a light-emitting device.

8. The control device according to claim 7, wherein the interface for supplying energy to a light-emitting device is designed for wireless energy transmission or for wired or for fiber optic energy transmission.

9. A lighting system comprising:

a light-emitting device having a first interface for supplying energy to the light-emitting device and a second interface for transmitting a control signal or multiple control signals for controlling a lighting property of a lighting source of the light-emitting device, wherein the first interface and the second interface are designed as multi-pole plug connectors; and a control device including an interface for transmitting a control signal or multiple control signals for controlling a lighting property of the lighting source of the light-emitting device and/or for receiving a status signal of the light-emitting device, wherein the one or more control signals include a dimming signal for controlling a light intensity of the lighting source and a flash signal for controlling at least one of lighting frequency and lighting duration of the lighting source, wherein the interface is designed to transmit a status signal or a fault signal, wherein the light emitting device includes a 5-pole plug connector, which includes the interface, wherein the 5-pole plug connector includes 5 contacts, wherein the first contact is allocated a supply voltage, the second contact is allocated the flash signal, the third contact is allocated a ground, the fourth contact is allocated the dimming signal, and the fifth contact is allocated the fault signal.

* * * * *